United States Patent [19]

Booij

[11] Patent Number: 4,565,206

[45] Date of Patent: Jan. 21, 1986

[54] APPARATUS FOR CLEANING A STEAM GENERATOR BY MEANS OF A HIGH-PRESSURE LANCE

[75] Inventor: Johannes Booij, Rhoon, Netherlands

[73] Assignee: Innus Industrial Nuclear Services S.A., Geneva, Switzerland

[21] Appl. No.: 609,112

[22] Filed: May 11, 1984

[30] Foreign Application Priority Data

Aug. 26, 1983 [BE] Belgium ..... 2/60192

[51] Int. Cl.[4] ..... F23J 3/02

[52] U.S. Cl. ..... 134/112; 15/104.1 R; 15/316 R; 122/381; 122/391; 122/392; 134/167 R

[58] Field of Search ..... 15/104.1 R, 316 R, 316 A, 15/317, 318; 74/479; 134/112, 149, 166 R, 166 C, 167 R, 167 C, 172, 198; 165/95; 122/390, 391, 392, 379, 381; 239/225

[56] References Cited

U.S. PATENT DOCUMENTS 3,311,092 3/1967 McMahon et al. ..... 122/392
4,079,701 3/1978 Hickman et al. ..... 122/382
4,257,359 5/1981 Capobianco ..... 122/390
4,354,294 10/1982 Silver ..... 15/317

FOREIGN PATENT DOCUMENTS 890490 1/1982 Belgium .
0061515 10/1982 European Pat. Off. .
2289850 5/1976 France .
2445487 7/1980 France .

*Primary Examiner*—Philip R. Coe
*Attorney, Agent, or Firm*—Stevens, Davis, Miller & Mosher

[57] ABSTRACT

The high-pressure lance is shiftably mounted in a bearing bush which is swingably mounted in a base which is to be secured over an opening in the wall of the steam generator. On the base are mounted a revolving cylinder which can swing the bearing bush to-and-fro over 180° and a cylinder-piston unit which can shift the lance. A pneumatic control mechanism couples the lance either by means of clamping-cylinders to the bearing bush during its swinging or by means of another clamping cylinder to the piston of the cylinder-piston unit during its shifting.

12 Claims, 3 Drawing Figures

III
30
31
28
1
39
24
25
23
17
19
20
10
18
II
II
12
21
5
7
8
6
37
38
34
38
35
6
4
36
3
11
2
9
14
15
13
26
16
33
III

APPARATUS FOR CLEANING A STEAM GENERATOR BY MEANS OF A HIGH-PRESSURE LANCE

BACKGROUND

This invention relates to an apparatus for cleaning a steam generator by means of a high-pressure lance, which apparatus comprises a base which is to be secured over an opening in the wall of the steam generator to be cleaned and which is provided with a lance passageway wherein the lance is rotatable about the axis thereof and slidable along the axial direction thereof, means for shifting the lance along the axial direction thereof relative to said base and means for rotating the lance about the axis thereof.

Apparatus of this kind are notably used for applying the method as disclosed in Belgian Pat. No. 889,706.

With such methods, the high-pressure lance is brought through an opening in the wall of the generator, into the space adjacent the end of the pipe bundle inside the generator. The high-pressure lance is provided at the end thereof with a spray head which is moved stepwise from the generator center to the wall. In each stepwise movement the spray head can spray between two pipe rows of the pipe bundle. The linear movement of the lance along the lengthwise axial direction thereof can be stopped for a time, and the lance is then rotated, so that the spray head sprays in all directions between the two pipe rows. The loosened sludge is sucked off by means of suction lines, from the generator bottom.

The problem encountered when applying such methods, is in stopping the linear motion of the lance at the proper moment and switching from the linear motion to a rotation of the lance.

In a known apparatus of the above-defined kind, which is used for applying such a method, the problem is solved by mounting the lance on a carriage which is slidable relative to the base, on the outer side of the generator. The lance is shifted together with the carriage, whereby the carriage is guided in guides which are mounted on the base. The revolving motion of the lance is obtained by means of an air motor which is mounted on the carriage, and which drives the lance directly.

Due to the requirement of using a carriage which moves over the same distance as the lance during cleaning, said known apparatus is quite cumbersome and costly.

Moreover the accuracy of shifting the lance is not satisfactory. The center-to-center spacing between the adjacent pipe rows of the steam generator is known and the movement mechanism of the carriage is so adjusted as to have said carriage move each time over such distance. The faults during the displacements add up with each succeeding movement, so that after a large number of rows and thus after a large number of lance movements, the position of the spray head may show a substantial difference relative to the desired position.

Automating the apparatus is also very difficult and this known equipment is also operated by hand on location. This latter feature is an important drawback when the equipment is for example being used for cleaning steam generators in nuclear power stations. In remaining in the vicinity of the generator during cleaning, the operators of the device may be subjected to radio-active exposure.

An object of the invention is to obviate such drawbacks and to provide an apparatus for cleaning a steam generator by means of a high-pressure lance which is of a relatively simple structure, which is very compact, which allows a very accurate working, and which can be automatically remote-controlled.

THE INVENTION

In consideration of the above objects, the means for rotating the lance as those means for shifting the lance comprise engageable and disengageable couplings.

Due to the couplings, it is not necessary that the means for rotating the lance move together with the lance movement during the shifting. Said means may be mounted on the base. The means for shifting the lance are only coupled to said lance during the shifting of the lance between two stoppages and thus two rotations. During the rotation, said means can bring the coupling back to the original position, so that the means for shifting the lance will cause but a limited displacement.

In a particular embodiment of the invention, the couplings are remotely engageable and disengageable.

Usefully the apparatus comprises a control device which controls the couplings that so when one coupling is engaged, the other one is disengaged.

In a remarkable embodiment of the invention, the couplings are of that type which, with an abnormally strong resistance to coupling, still allows for the movement of the parts to be coupled.

Preferably the couplings are of the non-rigid type.

In a useful embodiment of the invention, the means for rotating the lance about the axis thereof comprise a bearing bushing wherein the lance extends slidably along its axis direction, which bearing bushing is in turn rotatably mounted about the lance axis in the base, and the engageable and disengageable coupling of said means is mounted between said bearing bushing and the lance.

In a preferred embodiment of the invention, the means for shifting the lance along the axis direction thereof, comprise a double-acting cylinder-piston unit which is fixed on the one hand relative to the base, and which can on the other hand be coupled directly to the lance through the coupling of said means.

In another particular embodiment of the invention, the apparatus comprises at least one suction pipe which extends through an opening in the base, and a seal which sealingly closes the opening around the pipe, which seal comprises a part which surrounds the pipe and is secured to the base, and which is provided on the pipe side with at least one groove wherein a resilient sealing ring is arranged.

Other details and features of the invention will stand out from the following description of an apparatus for cleaning a steam generator by means of a high-pressure lance, according to the invention; this description is only given as example and does not limit the invention; the reference numerals pertain to the accompanying drawings.

DRAWINGS

In the various figures, the same reference numerals pertain to the same elements.

DESCRIPTION OF A PREFERRED EMBODIMENT

Figure 1:
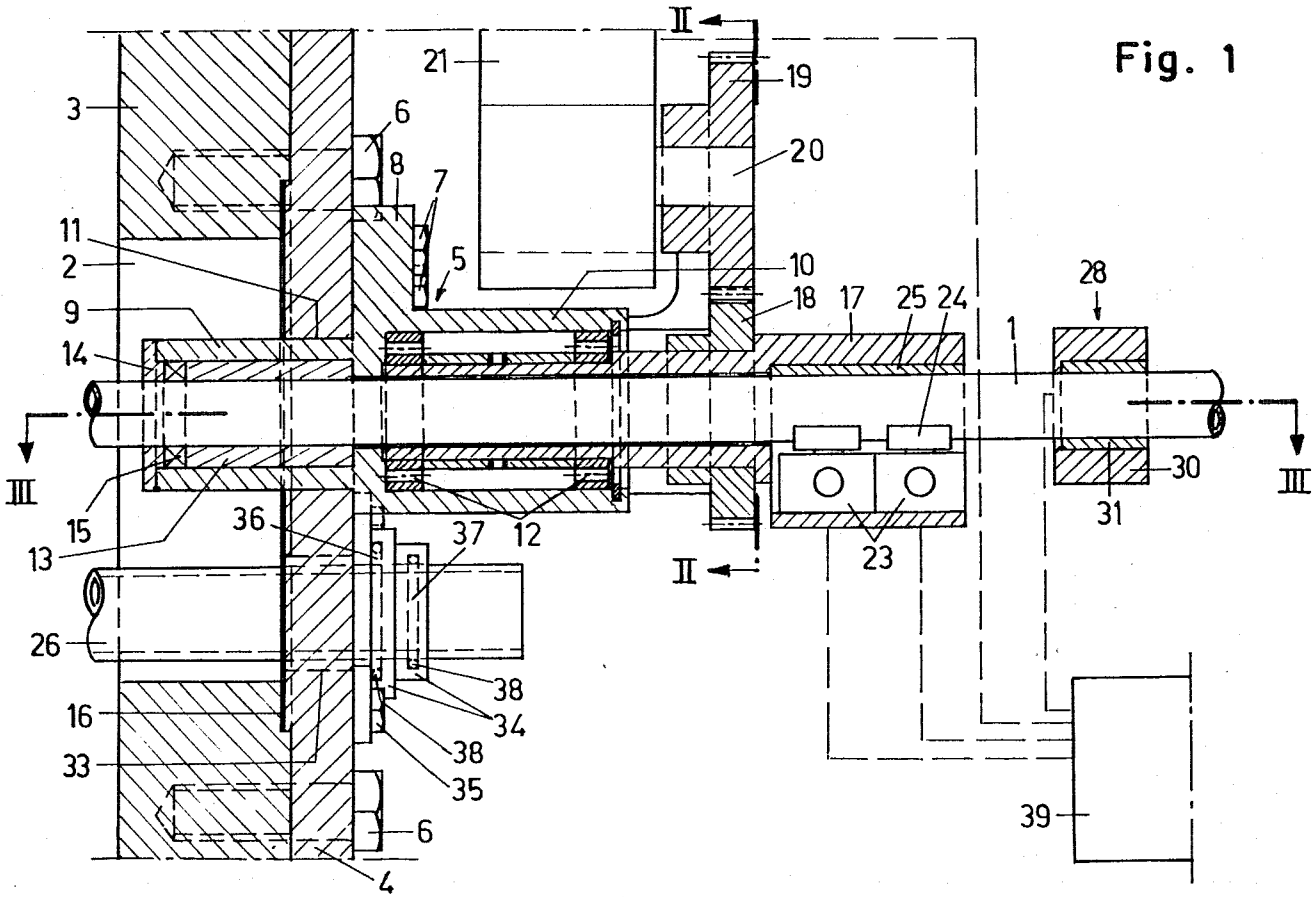
FIG. 1 shows a vertical section of a portion of the apparatus for cleaning a steam generator by means of a high-pressure lance according to the invention.
Figure 2:
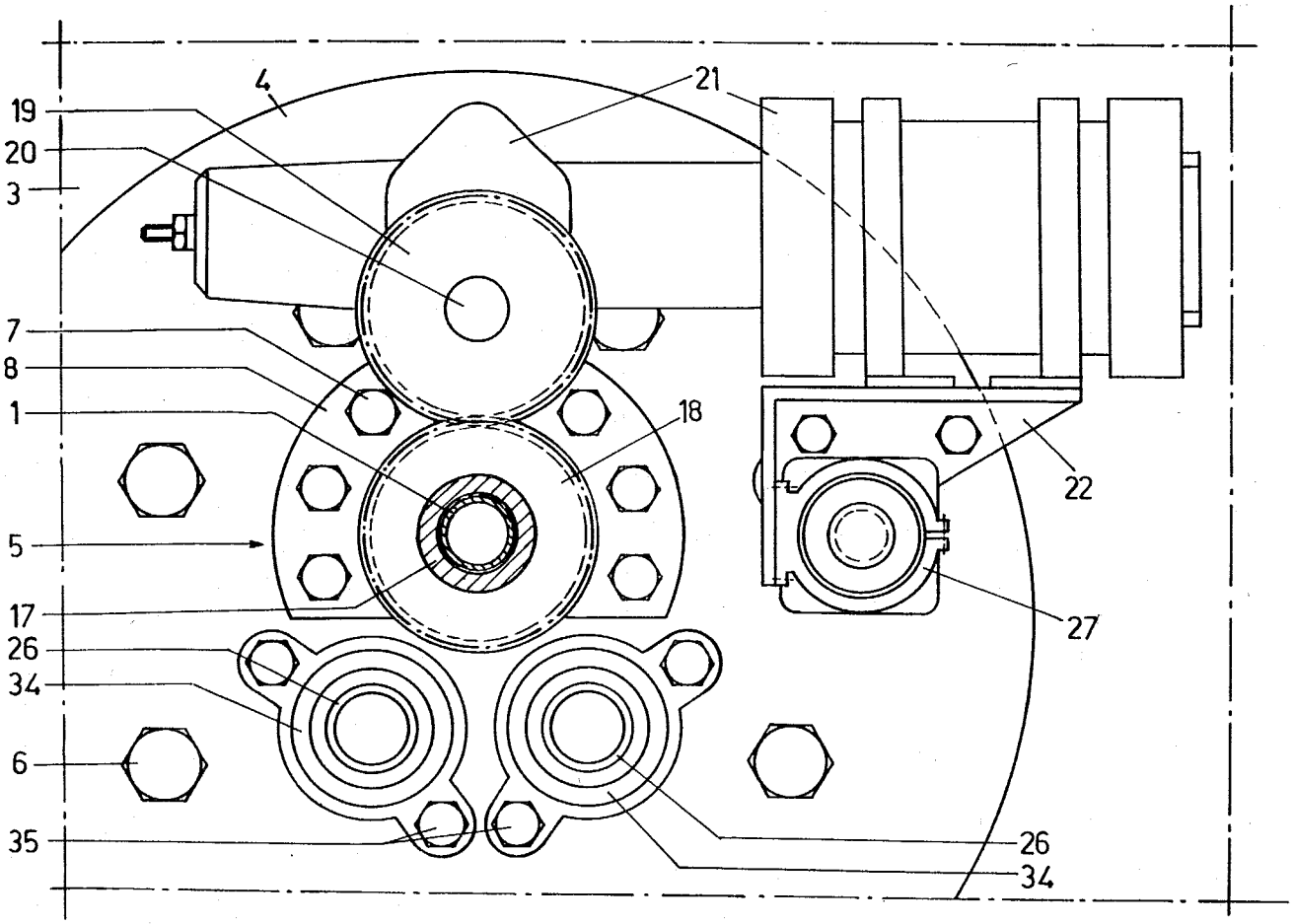
FIG. 2 is a cross-section along line II—II in FIG. 1.
Figure 3:
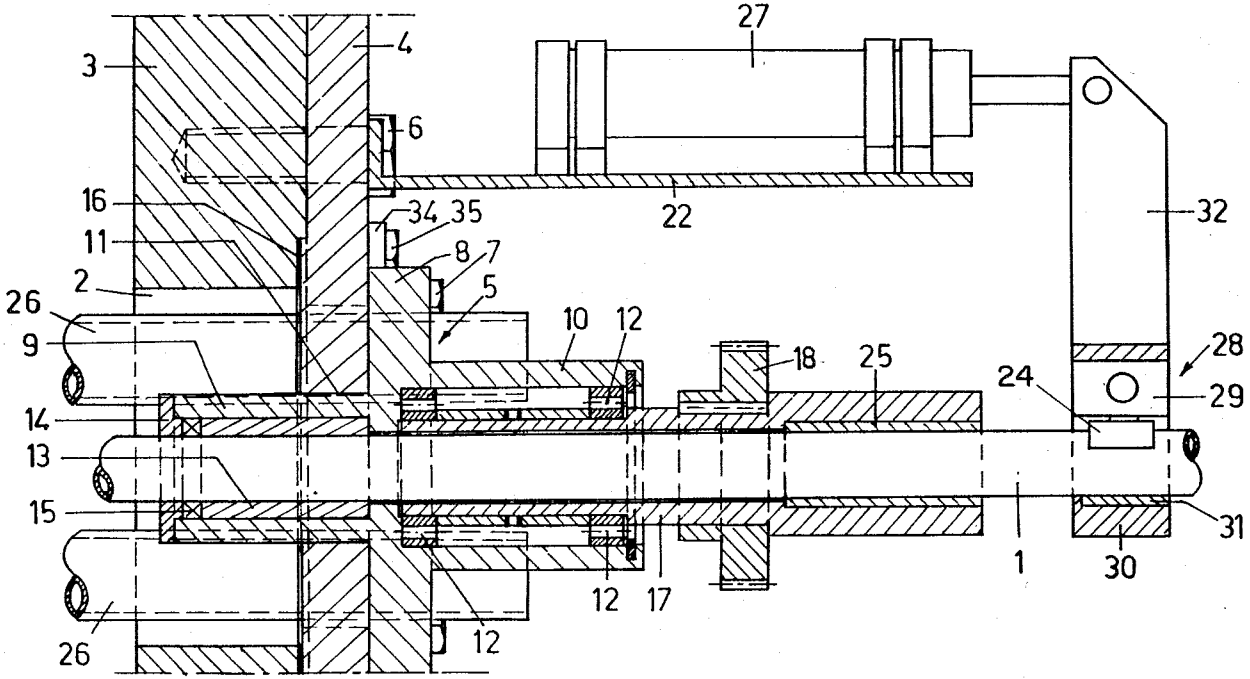
FIG. 3 is a cross-sectional along line III—III in FIG. 1.

The apparatus as shown in the figures comprises a high-pressure lance 1 which is arranged through an opening 2 in the wall 3 of the steam generator to be cleaned. That end lying inside the steam generator is provided in a known way with a spray head, while the other end connects through a so-called "swivel" coupling to a hose which communicates with a source of liquid under high pressure. For clarity, said spray head, coupling and high-pressure liquid source have not been shown.

The steam generator is of a structure known per se, and for clearness' sake, only a portion of the wall 3 and the opening 2 have been shown.

Around lance 1, the opening 2 is sealed by a base which is mainly comprised of a mounting flange 4, and a fixed part 5 secured thereon which forms both a guide during the shifting of the lance 1, and a bearing for the rotation of the lance 1.

The round mounting flange 4 is secured around the opening 2 by means of bolts 6, to the outer side of the wall 3 of the steam generator.

The fixed part 5 comprises a flange-forming portion 8 secured by means of bolts 7 on the outer side of said mounting flange 4, which portion 8 is markedly smaller than said flange 4, a bushing 9 connecting to said portion 8 which bushing extends around the lance 1 through an opening 11 in the mounting flange 4, and a somewhat larger bushing 10 which connects on the other side around the lance 1 to the portion 8, and which forms the bearing housing for roller bearings 12.

Between the lance 1 and the bushing 9 lies a nylon bushing 13. Inside the generator, a water seal 15 is arranged around the lance 1, between the end of said bushing 13 and an enclosing flange 14 secured to bushing 9. Between the flange 4 and the wall 3 also lies a sealing ring 16, so that in this way, the opening 2 around the lance 1 is sealed leak-free, while the lance 1 is still slidable and rotatable relative to the base 4,5.

Both roller bearings 12 in bushing 10 are not mounted directly between the bushing 10 and the lance 1, but actually between the bushing 10 and a bearing bushing 17 which surrounds loosely said lance 1, on the outer side of the steam generator.

Said bearing bushing 17 is part of means for rotating the lance 1 over 180°.

Said means further comprise a gear wheel 18 which surrounds that portion of bearing bushing 17 projecting outside the base 4,5, and which is positively secured on said bearing bushing 17. Said gear wheel 18 meshes with a gear wheel 19 which is secured on the output shaft 20 of a pneumatic revolving cylinder 21.

Said pneumatic cylinder comprises a cylinder-piston unit the piston of which bears a rack which meshes with a gear wheel which is mounted on the output shaft. Such a revolving cylinder is commercially available as such and will not further be described here in detail, nor is it shown in detail in the figures.

The revolving cylinder 21 is secured to a support 22 which is mounted next to the fixed part 5 on the mounting flange 4.

The means for rotating the lance 1, further comprises a remotely engageable and disengageable coupling, which is formed by two clamping cylinders 23.

Such clamping cylinders are known per se and will thus also not be described here in detail, nor shown in detail in the drawings. Said clamping cylinders 23 are mounted on the inner side of an extension of the bearing bushing 17 and comprise a pneumatically-movable clamp block 24, which is pressed against the lance 1 with the coupling engaged.

The lance 1 is surrounded in the location of the clamping cylinders 23 by a nylon bushing 25. The clamp blocks 24 pass through openings in said bushing.

The apparatus further comprises a pneumatic control mechanism 39 which controls as well the pneumatic revolving cylinder 21 so as to obtain a to-and-fro rotation over 180° of the lance as the clamping cylinders 23, in such a way that the revolving cylinder 21 and the clamping cylinders 23 are operative or unoperative at the same time. Thus when the revolving cylinder 21 rotates through the agency of the gear wheels 18 and 19, the bearing bushing 17 is coupled by the clamping cylinders 23 to the lance 1. The clamping cylinders also form a friction coupling, in such a way that should the rotation of the lance 1 be hindered for some reason, the bearing bushing can still rotate in spite of the engagement of coupling 23, relative to the lance 1, and damaging of lance 1 or components of the generator against which lance 1 may possibly lie, is excluded.

The structure of the pneumatic control mechanism 39 is clear for a man skilled in the art and it will not be described here in detail.

Said control mechanism 39 so controls the revolving cylinder 21 that at each to-and-fro movement of the piston thereof, the bearing bushing 17 is rotated over 180°. The lance 1 is thereby rotated over 90° to the left and to the right relative to the center position thereof, so that the spray head can cover the space between two adjacent pipe rows of the pipe bundle in all directions, and thereby the loosened sludge is distributed evenly over two suction pipes 26.

Between the two rotations of lance 1, said lance is moved over a distance equal to the center-to-center spacing between two adjacent pipe rows of the bundle. Said linear shifting occurs through means for shifting which comprises a double-action cylinder-piston unit 27 and a remotely engageable and disengageable coupling 28 between the piston of said unit 27 and the lance 1.

The cylinder of the cylinder-piston unit 27 is secured to said support 22, with the axis thereof in parallel relationship with the axis of lance 1.

The coupling 28 comprises a clamping cylinder 29 which has the same structure as said clamping cylinders 23. The clamping cylinder 29 is mounted in a ring 30 which surrounds the lance 1 on that side of base 4,5 removed from bearing bushing 17, and between said ring 30 and the lance lies a nylon bushing 31. The clamp block 24 of clamping cylinder 29 pushes, with the coupling 28 engaged, through an opening in said nylon bushing 31, against the lance. The couplings 28 and 23 are friction couplings and thus of the non-rigid type. With coupling 28 disengaged, the lance 1 is rotatable inside nylon bush 31.

The ring 30 is directly connected by a connecting part 32, to the end of the piston of the cylinder-piston unit 27.

Both cylinder-piston unit 27 and clamping cylinder 29 are controlled by said pneumatic control mechanism 39 and actually in such a way that, every time the piston of the cylinder-piston unit 27 is extended, the clamping cylinder 29 is operative and consequently the lance 1 is taken along and drawn out of the generator over a distance which corresponds to the spacing between the axis of pipes in adjacent rows of the pipe bundle, but every time the piston of the cylinder-piston unit 27 is withdrawn, the clamping cylinder 29 is unoperative and thus said clamping cylinder moves over the lance 1 without taking same along.

Said pneumatic control mechanism 39 is moreover so designed that, when said clamping cylinders 23 are operative, the clamping cylinder 29 is unoperative and conversely, when the clamping cylinder 29 is operative, the clamping cylinders 23 are unoperative.

This thus means that the lance 1 is either shifted along the lengthwise axis thereof, or rotated around said axis, but both movements cannot occur at the same time.

Due to the coupling 28, the cylinder-piston unit 27 does only have to be provided with a limited hose length, which is but equal to the usual spacing between the axis of the pipes in adjacent rows of the pipe bundle. During the rotation of lance 1, the piston of the cylinder-piston unit 27, and consequently also the coupling 28 return to the original position thereof relative to the lance 1, so that after engaging anew the coupling 28, said lance 1 can again be moved over a limited distance.

As during said shifting, the coupling 23 is disengaged, the means 17–25 for rotating the lance 1 may be mounted on the base 4,5 and they do not have to move together with lance 1 along the axis direction thereof.

All this results in a very compact and simple structure. The distance over which the lance 1 is shifted is determined by the cylinder-piston unit and may thereby be adjusted very accurately. The distance over which the lance 1 is displaced is also accurately the same every time.

The above-mentioned suction pipes 26 for sucking the sludge out of the steam generator may also pass through the mounting flange 4.

The apparatus as shown in the figures comprises two such suction pipes 26 which extend through openings 33 in said flange 4. On the outer side of the generator, suction hoses may be secured with special coupling parts to the pipes 26. For clarity, said coupling parts and suction hoses have not been shown in the figures.

The opening 33 around each pipe 26 is sealed by means of a ring-shaped sealing part 34 which is secured by means of two bolts 35 against the outer side of said mounting flange 4. Said sealing part 34 is provided with two U-shaped grooves 36 and 37 in each of which lies a resilient O-ring 38.

The groove 36 extends around the pipe 26 in that side removed from mounting flange 4 of the sealing part 34. The groove 37 lies in that side of the sealing part 34 which surrounds pipe 26.

The invention is in no way limited to the above-described embodiment, and within the scope of the patent application, many changes may be brought to the described embodiment, notably as regards the shape, the composition, the arrangement and the number of the components which are being used for embodying the invention.

Especially the use of the above described apparatus does not necessarily have to be as mentioned.

For instance, the apparatus does not necessarily have to draw the lance outwardly. It can push the lance stepwise inwardly. All depends on the manner the control mechanism controls the cylinder-piston unit and the clamping cylinder causing the shifting of the lance. If the clamping cylinder is operative when the piston of the cylinder-piston unit is retracted, the lance is shifted inwardly.

It can of course be necessary to mount the apparatus on several places on the steam generator to obtain a complete cleaning. Also it is possible to use simultaneously two or more apparatus as described, each apparatus cleaning a part of the steam generator.

I claim:

1. An apparatus for cleaning a steam generator by means of a high-pressure lance, which apparatus comprises:
   - a base which is to be secured over an opening in the wall of the steam generator to be cleaned, and which is provided with a lance passageway wherein said lance is rotatable and axially shiftable;
   - a first engageable and disengageable friction coupling mounted on the lance;
   - means for shifting axially to-and-fro said first coupling;
   - a second engageable and disengageable friction coupling mounted on the lance;
   - means for rotating said second coupling; and
   - a control mechanism for controlling the couplings so that when the one coupling is engaged, the other one is disengaged.

2. The apparatus as defined in claim 1, in which the friction couplings comprise at least one clamping cylinder.

3. The apparatus as defined in claim 1, in which the means for rotating the second coupling are means for rotating said coupling to-and-fro over 180°.

4. The apparatus as defined in claim 1, in which the means for shifting axially said first coupling comprise a double-action cylinder-piston unit mounted between the base and said first coupling.

5. The apparatus as defined in claim 1, in which the control mechanism is a mechanism engaging the first coupling during a number of successive shiftings in one and the same direction by the means for shifting and disengaging said first coupling each time, between the above-mentioned successive shiftings, said means for shifting return said first coupling in the opposite direction.

6. An apparatus for cleaning a steam generator by means of a high-pressure lance, which apparatus comprises:
   - a base which is to be secured over an opening in the wall of the steam generator to be cleaned, and which is provided with a lance passageway wherein said lance is rotatable and axially shiftable;
   - a first engageable and disengageable friction coupling mounted on the lance;
   - means for shifting axially to-and-fro said first coupling;
   - a bearing bushing wherein said lance extends slidably, which bearing bushing is in turn rotatably supported in the base;
   - a second engageable and disengageable friction coupling mounted between the bushing and the lance;
   - means for rotating said bushing; and
   - a control mechanism for controlling the couplings so that when the one coupling is engaged, the other one is disengaged.

7. The apparatus as defined in claim 6, in which the means for rotating the bushing comprise a gear wheel which is fixedly mounted around the bearing bushing and means for driving said gear wheel.

8. The apparatus as defined in claim 6, wherein the means for driving said gear wheel comprises a pneumatic revolving cylinder.

9. The apparatus as defined in claim 6, wherein the means for rotating the bushing are means for rotating said bushing to-and-fro over 180°.

10. The apparatus as defined in claim 6, in which the control mechanism is a mechanism engaging the first coupling during a number of successive shiftings in one and the same direction by the means for shifting and disengaging said first coupling each time, between the above-mentioned successive shiftings, said means for shifting return said first coupling in the opposite direction.

11. An apparatus for cleaning a steam generator by means of a high-pressure lance, which apparatus comprises:

a base which is to be secured over an opening in the wall of the steam generator to be cleaned, and which is provided with a lance passageway wherein said lance is rotatable and axially shiftable;

a first engageable and disengageable friction coupling mounted on the lance;

means for shifting axially to-and-fro said first coupling;

a second engageable and disengageable friction coupling mounted on the lance;

means for rotating said second coupling;

a control mechanism for controlling the couplings so that when the one coupling is engaged, the other one is disengaged;

at least one suction pipe which passes through an opening in the base; and a seal which sealingly closes the opening around said pipe, which seal comprises a part which surrounds the pipe and is secured to the base, which part is provided on the side of said pipe with at least one groove, a resilient sealing ring being arranged in said groove.

12. The apparatus as defined in claim 11, in which said part which surrounds the pipe is also provided on the side thereof facing the base with a groove which surrounds the lance, a resilient sealing ring being arranged in said groove.

* * * * *